United States Patent [19]

Karlsson

[11] 3,969,774

[45] July 20, 1976

[54] FLUSHING AND REFILLING APPARATUS

[75] Inventor: Frans Harry Karlsson, Lund, Sweden

[73] Assignee: Hykon-Patent Aktiebolag, Sweden

[22] Filed: Dec. 12, 1974

[21] Appl. No.: 532,148

[30] Foreign Application Priority Data

Dec. 12, 1973 Sweden ..... 7316759

[52] U.S. Cl. ..... 4/41; 4/34; 4/58

[51] Int. Cl.[2] ..... E03D 1/30

[58] Field of Search ..... 4/41, 34, 67 A, 58, 4/60, 61, DIG. 1

[56] References Cited

UNITED STATES PATENTS

| | | | |
|---|---|---|---|
| 3,186,007 | 6/1965 | Falotico | 4/67 A X |
| 3,777,316 | 12/1973 | Coetzee | 4/58 |
| 3,906,554 | 9/1975 | Johnson | 4/34 |

FOREIGN PATENTS OR APPLICATIONS

| | | | |
|---|---|---|---|
| 647,271 | 4/1964 | Belgium | 4/58 |
| 360,417 | 1/1974 | Sweden | |
| 563,068 | 12/1957 | Switzerland | 4/58 |

*Primary Examiner*—Richard E. Aegerter
*Assistant Examiner*—Larry Jones
*Attorney, Agent, or Firm*—Beveridge, De Grandi, Kline & Lunsford

[57] ABSTRACT

A flushing and refilling apparatus for use in a flushing cistern includes flushing and refilling valves, an overflow member and a common support having quick release coupling means for easy mounting and dismounting of said apparatus and said overflow member as a unit of assembled parts.

12 Claims, 2 Drawing Figures

FLUSHING AND REFILLING APPARATUS

This invention relates to flushing and refilling apparatuses for use with flushing cisterns and in particular with water closet cisterns.

In known water closet installations the closet is flushed by unseating a flushing valve in the flushing cistern to allow water to flow from the cistern to the pan. The unseating of the flushing valve for flushing the cistern is accompanied by the opening of a refilling valve to start a flushing and refilling cycle. The flushing completed, the flushing valve returns by gravity to its closed position, whereupon the cistern is filled by water entering through the open refilling valve. The refilling cycle is completed in that the refilling valve is closed by a refilling valve closing means which is actuated by water when the cistern is filled up to a predetermined level. There are two main systems for closing the refilling valve automatically in dependence upon the water in the cistern. In the first system, to which this invention relates, the refilling valve closing means comprises a float placed in the tank and connected by links to the refilling valve. According to the second system, the refilling valve closing means includes an overflow and a valve closing element connected to the refilling valve and mounted in the overflow to be acted upon by water flowing into the overflow and thereby to effect closing of the refilling valve.

Experience has shown that the flushing and refilling valves with their operating means are apt to give rise to functional disturbances in the flushing cistern. Consequently, these two units need to be inspected and possibly repaired or replaced more often than the other parts of or in a flushing cistern, in which case they must be either wholly or partly removed from the cistern.

In prior art constructions this entails the unfastening of a number of screw connections, cotter pins etc.; a relatively time-consuming operation which must be carried out by skilled workers. The reinstallation of the removed parts entails similar problems, apart from which certain adjustments of said parts and mating parts of the cistern are often necessary. In view of the fact that it is generally unsuitable to dismount and remove the cistern, among other things because of sealing difficulties, the plumber's working conditions are far from ideal as regards working position, space and visibility.

The object of the present invention is to provide a flushing and refilling apparatus which possess all of the properties required in modern flushing cisterns, such as quiet filling, rapid shut-off and simple and reliable function, and which will in a substantial degree eliminate the problems described above.

Another object is to provide a flushing and refilling apparatus, the main members of which together with a common support or frame are assembled as a unit which is easily mounted in and dismouned from the cistern and in which the members forming said unit are easily mounted and dismounted in relation to each other.

A further object is to construct the members forming said unit in such a manner that they will be cheap to produce and assemble.

Thus, the present invention provides a detachable flushing and refilling apparatus for flushing cisterns having a bottom wall member with an outlet and a flushing valve seat connecting a lower part of the cistern to the discharge opening, and a refilling valve for regulating flow of liquid into the cistern, comprising, as an assembled unit, a refilling valve connected to a water mains, a flushing valve seat with an outlet, a flushing valve disposed for opening and closing the outlet in the flushing valve seat, and a lifting mechanism disposed for opening the flushing valve, wherein the refilling valve, the flushing valve and the lifting mechanism are mounted on or in a common frame and, together with said frame, form a unit which includes a coupling device for easily detachable connection with the flushing cistern.

The flushing and refilling apparatus according to the present invention achieves all of the above-indicated objects, and its most distinguishing feature is that its vital parts are concentrated to and integrated in a space-saving main unit which can be removed from the cistern with a few simple manipulations. This main unit includes, int.al. the flushing valve and the refilling valve with float. A new unit or a renovated replacement unit can be installed in the cistern just as quickly as the old main unit can be removed. Thus, the entire servicing operation necessary at the site of the cistern can be carried out in one or two minutes, for which reason the plumber (who need not be a skilful repairer) can carry out many more servicing visits per day than has been the case hitherto. Moreover, the water closet need not be out of action for any appreciable time, and, if necessary, the entire replacement operation can be carried out by any handyman without calling on the services of a professional plumber.

Apart from the fact that the integral construction of the flushing and refilling apparatus according to the invention facilitates servicing, it permits greater adaptibility to other types of cisterns than is the case in prior art embodiments. In other words, a flushing and refilling apparatus according to the invention which was originally manufactured for a certain type of cistern easily fits into other types of cisterns. This is seldom the case in prior art apparatuses because of the separate affixing of the float valve in the cistern and because of the space required for the movement of the float between its extreme positions and for the flushing valve and the lift stem which complete with the float for the space available.

An embodiment of the invention will be described in greater detail hereinbelow and with reference to the accompanying drawings in which.

Figure 1:
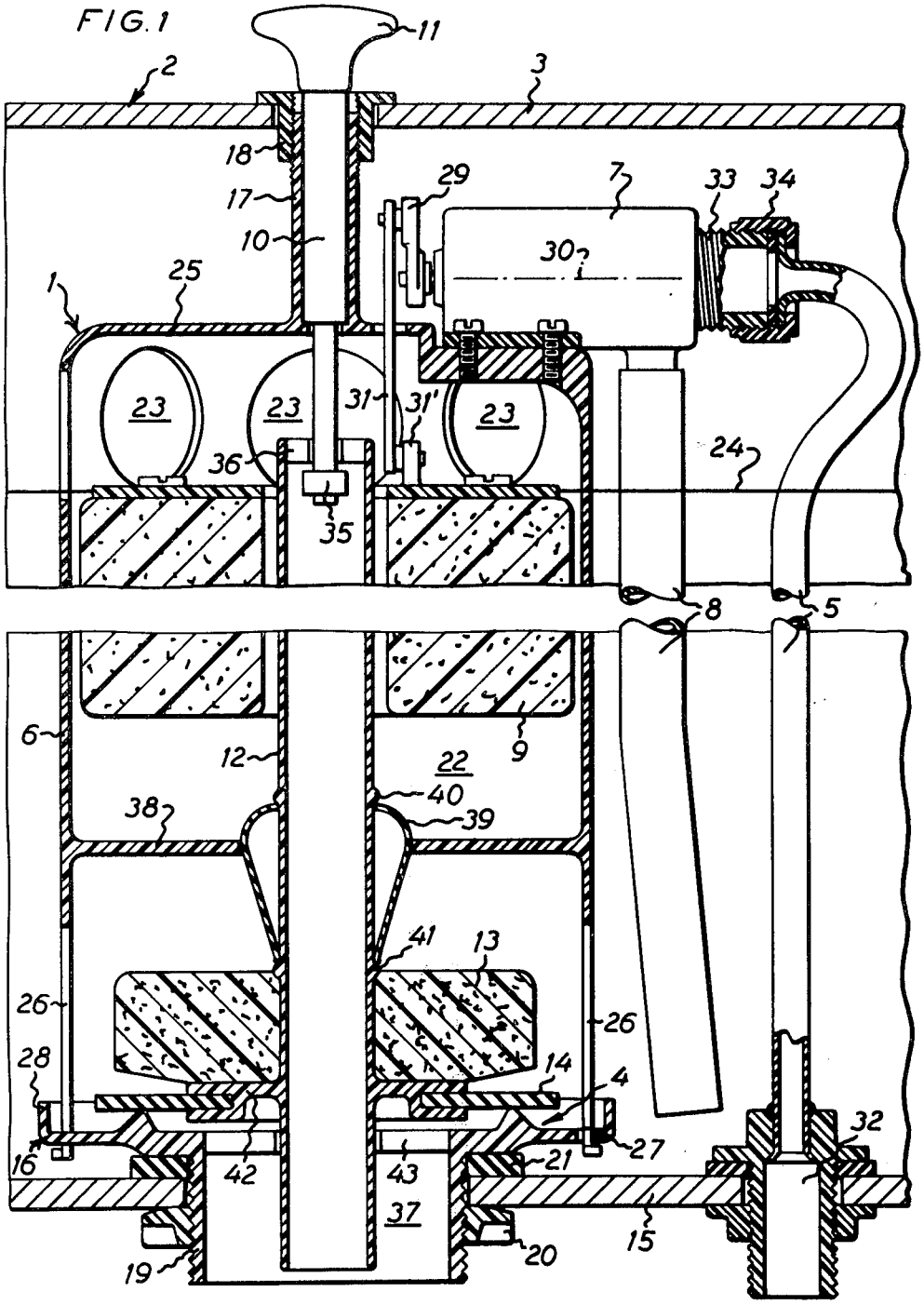
FIG. 1 is a vertical section on the line I—I in FIG. 2 of a flushing and refilling apparatus according to the present invention mounted in a flushing cistern, the flushing cistern itself being shown only fragmentarily.

The flushing and refilling apparatus shown on the drawing substantially comprises a main unit composed of sub-units, the main unit being generally designated 1 and being easily removably mounted in a substantially conventional flushing cistern 2 with a cover 3, a flushing valve seat 4 and a water inlet pipe 5. This main unit 1 (most details of which can advantageously be of plastics) comprises, as sub-units, a frame 6, a refilling valve 7 with an outlet pipe 8 and a float 9, a lift stem 10 with a handle 11, and a liftable overflow pipe 12 with a float 13 and a flushing valve 14 for cooperation with the flushing valve seat 4. The main unit 1 which thus includes all of the parts of flushing and refilling apparatus with the sole exceptions of the flushing valve seat 4 and the inlet pipe 5, is connected to the bottom 15 of the flushing cistern by means of a connecting device 16 which permits easy mounting and dismounting of the main unit 1. In the illustrated embodiment the connecting device 16 is a bayonet clutch between the lower part of the frame 6 and the flushing valve seat 4, the unit 1 being supported at the top by means of a tubular frame portion forming a guide tube 17 for guiding the lift stem 10. The guide tube 17 is detachably connected to the cover 3 of the cistern by means of a flanged pipe nub 18 which is inserted, from the outside, into a hole in the cover 3 and is screwed onto a threaded end portion of the guide tube 17 and abuts, with its flange, against the upper side of the cover 3.

In the illustrated embodiment the flushing valve seat 4 is provided with a threaded tubular socket 19 which is mounted in an outlet opening in the bottom 15 of the flushing cistern and is fixed thereon by means of a nut 20 and sealed by means of a sealing ring 21 which is clamped between the flushing valve seat 4 and the bottom 15 of the cistern.

The major portion of the frame 6 forms a cylindrical housing with a vertical axis, the major part of the housing defining a chamber 22 which, in the following, will be designated "float chamber", since it houses the float 9 of the refilling valve 7. The cylindrical wall of the frame is, at its upper end portion, perforated by a row of in-flow holes 23, the bottom edges of which lie on the same level 24. When the cistern 2 is filled with water up to the level 24, the water can freely run into the float chamber 22 through the inlet holes 23.

At the upper end of its cylindrical portion the frame 6 is provided with an end wall 25 forming a platform on which the refilling valve 7 is detachably mounted by means of screws. The above-described frame portion 17 which forms the upper support for the unit 1 and a central guide tube for the lift stem 10 is, in the illustrated embodiment integral with the end wall 25.

At its bottom end portion, the frame 6 is perforated by four holes which, in the circumferential direction, are defined by four relatively narrow vertical wall portions forming four vertical legs 26 extending through slots 27 in a radially projecting collar-shaped portion 28 of the flushing valve seat 4 and are provided with recesses which, together with the slots 27 and the collar-shaped portion 28, form the above-mentioned bayonet clutch 16.

The refilling valve 7 can be of any given prior art type, but is preferably of the silent type. The device which opens and closes the valve 7 consists of a valve operating arm 29 connected to the valve member of the refilling valve and rotatable about the longitudinal axis 30 of the valve. When the valve operating arm 29 assumes the position shown in FIG. 1 (and also in FIG. 2) the valve 7 is closed. The upper end of a link 31 is rotatably mounted to the upper end of the valve operating arm 29, the link extending downwardly and supporting, at its lower end, the float 9 of the refilling valve by means of a suspension device 31 which allows the float 9 a certain freedom to swing. The float 9, whose buoyant body can be of, for example, porous plastics, has a central through hole which takes up the central overflow pipe 12 with a certain clearance, and occupies a great part of the float chamber 22, while having sufficient free height for movement between an upper and a lower position and a certain clearance both in relation to the overflow pipe 12 and to the inside of the frame 6. The float 9 opens the refilling valve 7 on movement to a lower end position from the upper position shown in FIG. 1, in which position the valve 7 is closed. This sequence is reversed for the closing of the refilling valve 7 by the float 9.

The inlet pipe 5 connects the cistern inlet 32 which is tightly affixed in the bottom 15 of the cistern 2, to the inlet of the valve 7, the inlet protruding from the valve housing with an externally threaded portion 33 and being connected to the pipe 5 by means of an easily detachable knurled sleeve nut 34.

The outlet pipe 8 conducts the water flowing out from the refilling valve 7 down to the region of the bottom 15 of the cistern 2 below the lowest water level in the cistern, thereby to avoid disturbing splashing noises. The lowest water level in the cistern is determined by the flushing valve seat 4 whose seat surface is located a slight distance above the lower end of the outlet pipe 8.

The flushing and refilling apparatus is operated conventionally by means of the handle 11 which is screwed to the upper end of the lift stem 10. The lift stem extends downwardly into the upper open end of the overflow pipe 12 and has, at its lower end, a head 35 which forms an abutment for cooperation with a pair of radially inwardly directed projections 36 on the inside of the rim of the overflow pipe 12. Thus, as the handle 11 is lifted, the overflow pipe 12 is also lifted by the lift stem 10. However, when the handle 11 is released and the lift stem 10 returns to its lower position, the overflow pipe 12 can remain in its raised position since the portion of the lift stem located above the head 35 is movable between the projections 36.

The overflow pipe 12 extends coaxially through the float chamber 22 and through the hole in the float 9 and reaches down into the cistern outlet 37 in the socket 19. The overflow pipe 12 supports, at its lower end portion, the flushing valve 14, thus forming a portion of the lift stem 10, with the differences described above and further apparent from the following. In the shown closed position of the flushing valve 14 the rim of the overflow pipe 12 reaches upward a short distance above the level 24 indicating the highest water level in the filled cistern. Thus, the overflow pipe 12 can serve as a reverse outlet for the water (the conventional function for an overflow in flushing cisterns) if the water for any reason rises above the level 24.

As has been mentioned above, the pipe 12 extends freely through a hole in the float, the pipe 12 also extending freely through a hole in a transverse partition 38 in the frame, forming the bottom wall of the float chamber 22. However, when the pipe 12 is in its lowermost position (that of FIG. 1) the space between the edge of the hole in the bottom wall 38 is sealed by a conical rubber sleeve 39 which is forced onto the overflow pipe 12 and is axially fixed by means of annular beads 40, 41 on the pipe 12 on either side of the rubber sleeve 39.

For connection with the flushing valve 14, the overflow pipe 12 has an annular flange 42 formed with an annular radial groove in which the disc-shaped flusing valve 14 is fixed in a per se known arrangement.

Just above the flange 42 and thus just above the flushing valve 14, the overflow pipe 12 supports the above-mentioned float 13 which consists of a toroid body of, for example, porous plastics and is connected to the pipe 12 between the lower annular bead 41 and the flange 42. When the pipe 12 is in the lowermost position the flushing valve 14 rests on the flushing valve seat 4, thereby sealing the cistern outlet 37. The flushing valve seat 4 displays, at the uppeer end of the inner circumferential surface of the socket 19, a few radially inwardly directed vanes 43 for guiding the lower end portion of the pipe 12.

The above-described flushing and refilling apparatus operates in the following way.

In the position of preparedness shown in FIG. 1 the cistern 2 is filled with water up to the level 24. The float chamber 22 is completely filled with water. The float 9 is, therefore, in its uppermost position and keeps the refilling valve 7 closed. The overflow pipe 12 is in its lowermost position and keeps the flushing valve 14 closed.

On flushing the lift stem 10 is pulled upwardly by means of the handle 11, the overflow pipe 12 and thereby the flushing valve 14 being lifted, and the water in the cistern 2 beginning to flow out past the frame legs 26 through the flushing valve seat 4 and the cistern outlet 37 to the water closet pan. This method of operation is well-known, apart from the constructional differences.

When the handle 11 is released after being pulled up, the lift stem 10 falls to the position of preparedness shown in FIG. 1 but the overflow pipe 12 with int.al. the flushing valve 14 remains, for the time being, in the upper position because of the buoyancy of the float 13.

Thus, in this phase the flushing valve 14 is open and the overflow pipe 12 is in its uppermost position where it has been stopped by its upper end abutting against the underside of the frame end wall 25, the conical rubber sleeve 39 no longer filling the hole in the bottom 38 of the float chamber 22. As a result, the float chamber 12 is emptied at the same time as the cistern 2 is emptied through the outlet 37, since the water in the float chamber flows out through the hole in the wall 38 and to the outlet 37. At the same time as the water level sinks in the float chamber 22, the float 9 sinks because of its weight, to its lowermost position and switches by the intermediary of the link 31 and the arm 29) the refilling valve 27 to the open position. Water is then led from the cistern inlet 32 which is connected to a water mains (not shown) through the inlet pipe 5 and via the valve 7 out through the outlet pipe 8.

When the water in the cistern 2 has been substantially drained off and the float 13 connected to the pipe 12 loses its buoyancy, the fushing valve 14 falls down onto the valve seat and closes the outlet 37 in the manner normal in flushing cisterns. At this point the passage between the overflow pipe 12 and the hole in the bottom 38 of the float chamber is also closed by means of the rubber sleeve 39.

In this phase the flushing valve 14 is closed while the refilling valve is, for the time being, open, with the result that the water level rises in the cistern to reach, after about a minute, the level 24 determined by the level of the lower defining edges of the in-flow holes 23 in the upper region of the float chamber 22. Prior to this, no water has run into the float chamber 22 (or in any event no appreciable amount) since the rubber sleeve 39 provides a satisfactory seal. However, when the water reaches the in-flow holes 23 and flows therethrough into the float chamber 22 the chamber fills very rapidly, with the result that the float 9 is lifted and quickly switches the refilling valve 7 to the closed position. The position of preparedness of the cistern is thereby reset.

As has been mentioned above, the main unit 1 of the flushing and refilling apparatus can very easily be removed from the cistern for maintenance and service, this operation being carried out as follows.

Once the handle 11 and the flange nut 18 have been unscrewed in the normal way, the cover 3 is lifted off, the nut 34 is then unscrewed so that the inlet pipe 5 is separated from the refilling valve 7. Thereupon the main unit 1 is twisted free from the bayonet clutch 16. The entire main unit 1 can then be lifted out of the cistern. Only the flushing valve seat 4 proper and the inlet pipe 5 with associated details are left in the cistern, but these parts seldom or never require maintenance or replacement.

Figure 2:
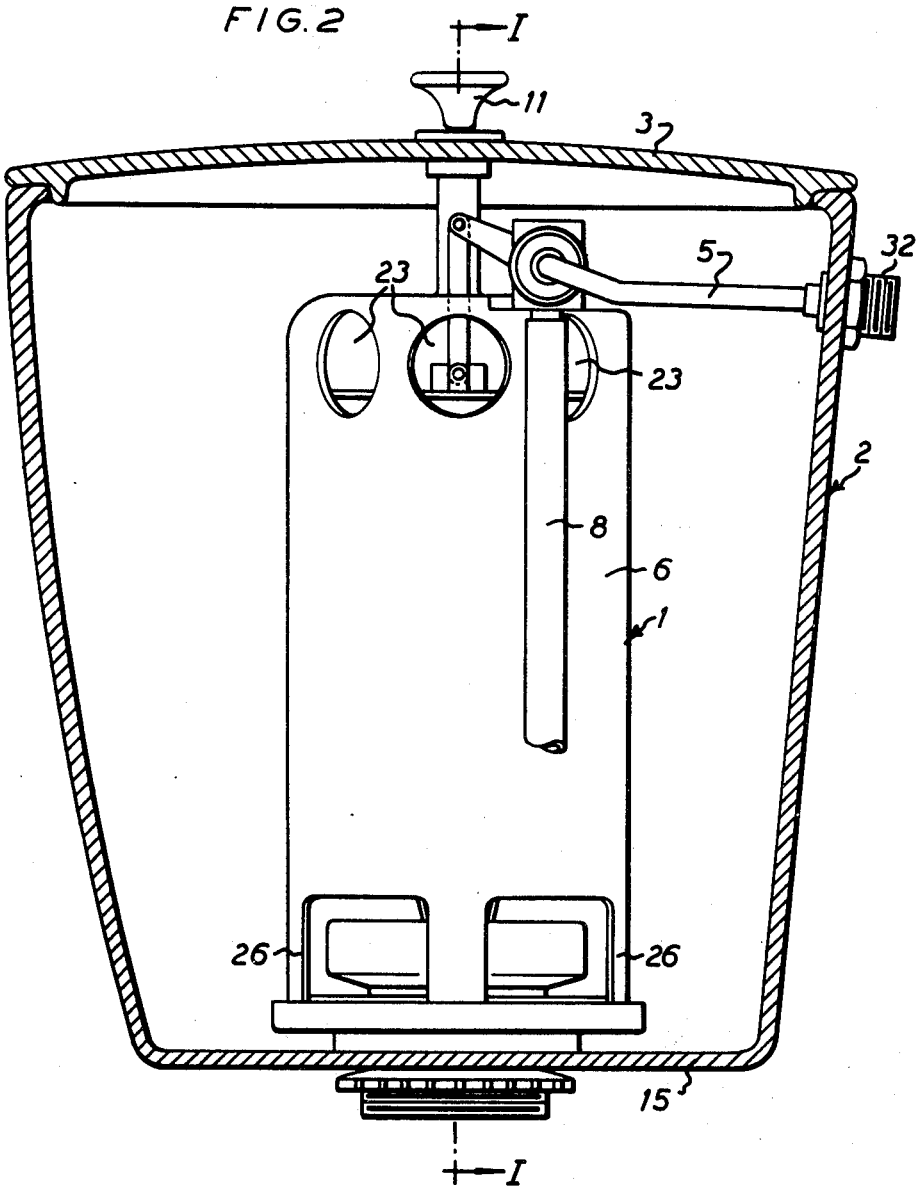
FIG. 2 is a side elevation of the flushing and refilling apparatus of FIG. 1, on a smaller scale and showing the flushing cistern in vertical section at right angles to the plane of FIG. 1, the conduit connection to the refilling valve and its connection to the cistern being modified.

FIG. 2 shows a modification which differs from the embodiment of FIG. 1 only in that the cistern inlet 32 is placed in the rear wall of the cistern instead of at its bottom, and that the inlet pipe 5 is adapted to suit the changed location of the inlet 32. The main unit 1 is the same as in FIG. 1.

In both embodiments the sub-units of the main unit 1 are easily detachable from each other, thus facilitating the necessary maintenance work when the unit 1 has been removed from the cistern 2.

The operational design of the flushing and refilling apparatus according to the invention can be modified in many ways in relation to the above-described embodiment. An obvious example of such modification is an embodiment in which the water in the float chamber 22 is not emptied in the manner described above and shown in FIG. 1, by lifting the overflow pipe 12, thereby uncovering a hole in the bottom 38 of the float chamber, but is instead emptied through a one-way valve in this bottom wall 38 or in the lower region of the float chamber wall. This one-way valve which may be of any known type should, in this instance, as a non-return valve, be able to permit the passage of water out of the float chamber but should be able to prevent the penetration of water, thereby replacing the rubber sleeve 39.

It is further to be observed that the apparatus does not necessarily need to include a specific float chamber 22, for the float 9 need not be enclosed but can be in direct communication with the cistern water. The desired rapid shut-off must, in this case, be achieved in some per se known manner.

In the embodiments shown in FIGS. 1 and 2 the boundary between the easily removable main unit 1 and the cistern 2 runs between the frame 6 and the flusing valve seat 4. Of course, this is not necessary, since the flushing valve seat 4 may also be included in the main unit 1. The hole in the bottom 15 of the cistern 2 can then be provided with a coarse thread in which is screwed the flushing valve seat 4. On dismounting the assembly, the entire main unit 1 is unscrewed, including the flushing valve seat 4 which, in this case, is removed with the main unit. In other words, this modification entails that the rapidly releasable coupling between the flushing valve seat 4 and the frame 6 is replaced by a rapidly releasable coupling between the flusing valve seat 4 and the bottom 15 of the cistern 2. Other detail modifications which can be carried out without difficulty by a person skilled in the art also fall within the spirit and scope of the invention.

What we claim and desire to secure by Letters Patent is:

1. A cistern flush and refill system comprising a cistern provided with an upper wall and a discharge opening in its bottom wall and an inlet connected to a source of liquid under pressure, said system further comprising, a flushing valve seat forming a passage between a lower part of the cistern and said discharge opening, an assembly comprising as assembled parts a common support, a refilling valve, a flushing valve and an overflow pipe, manually-operable coupling means for connecting said common support to said cistern and for permitting easily detachable connection of said common support to said cistern, said refilling valve mounted on said common support and having means for detachably connecting said refilling valve to said inlet, said flushing valve being movable between an open position and a closed position where it closes said flushing valve seat, seat overflow pipe communicating between said flushing valve seat and an upper level of said cistern, said overflow pipe being connected to said flushing valve for movement therewith and being movably supported on said common support to permit movement of the flushing valve between its open and closed positions, valve opening means connected to said flushing and refilling valves for opening said valves to start a flushing and refilling cycle, and valve closing means for closing said refilling valve, said closing means being connected to said refilling valve.

2. A system as claimed in claim 1, wherein said common support extends upwardly in said cistern, said manually-operable means including a first quick release coupling member on said assembly at its lower end, a second quick release coupling member affixed to said cistern adjacent the bottom thereof.

3. A system as claimed in claim 1, wherein said assembly also includes the flushing valve seat, said seat being supported by said common support, said manually-operable means being a coupling device for connecting the flushing valve seat to the discharge opening of the cistern.

4. A system as claimed in clam 1, wherein said overflow pipe extends through and is fixed to said flusing valve and forms part of said valve opening means.

5. A system as claimed in claim 1, wherein said common support comprises a housing having openings for free liquid communication between the cistern and the interior of said housing, said valve closing means comprising a float mounted in said housing, and connecting means for connecting said refilling valve and said float, said float being supported in said housing by said refilling valve via said connecting means.

6. A system as claimed in claim 5, having a buoyant body supported on said overflow pipe above said flushing valve.

7. A system as claimed in claim 5, wherein said overflow pipe extends through and is affixed to said flushing valve, said overflow pipe communicating between said discharge opening and the upper portion of said cistern, said float in said housing having a central opening, said overflow pipe extending upwardly through said opening in said float and having a diameter which is less than the diameter of said opening, whereby said overflow pipe and said float are movable in relation to each other.

8. A system as claimed in claim 7, wherein said housing has a partition below said float, said partition having a central opening for free passage of said overflow pipe, elastic sealing means on said overflow pipe to seal the opening in said partition.

9. A system as claimed in claim 7, having a link movably suspending said float in said housing, a crank fixed to the refilling valve, and a pivot connecting said link to said crank.

10. A system as claimed in claim 1, wherein said coupling means is a bayonet clutch for connecting the lower end of said support to said flushing valve seat.

11. A system as claimed in claim 1, wherein said coupling means is a quick coupler between the flushing valve seat and said discharge opening in said cistern bottom.

12. A system as claimed in claim 1, wherein said common support has a guide portion which forms a guide for the valve opening means, means for detachably connecting the guide portion to an opening in the upper wall of a cistern.

* * * * *

UNITED STATES PATENT AND TRADEMARK OFFICE

CERTIFICATE OF CORRECTION

PATENT NO. : 3,969,774

DATED : July 20, 1976

INVENTOR(S) : FRANS HARRY KARLSSON and PER TORSTEN FAXÉN

It is certified that error appears in the above—identified patent and that said Letters Patent is hereby corrected as shown below:

In the heading on page 1, add the name of the following coinventor:

PER TORSTEN FAXÉN

Bromma, Sweden.

Signed and Sealed this

*Sixteenth* Day of *August 1983*

[SEAL]

*Attest:*

GERALD J. MOSSINGHOFF

*Attesting Officer*

*Commissioner of Patents and Trademarks*